US007325807B1

(12) United States Patent
Eason

(10) Patent No.: US 7,325,807 B1
(45) Date of Patent: Feb. 5, 2008

(54) BEER PONG TABLE

(76) Inventor: Derek Eason, 1219 E. Main St., Plymouth Meeting, PA (US) 19462

( * ) Notice: Subject to any disclaimer, the term of this patent is extended or adjusted under 35 U.S.C. 154(b) by 122 days.

(21) Appl. No.: 11/128,455

(22) Filed: May 13, 2005

(51) Int. Cl.
*A63B 67/00* (2006.01)
*A63B 63/00* (2006.01)
*A63F 7/00* (2006.01)

(52) U.S. Cl. ..... 273/342; 273/400; 473/496

(58) Field of Classification Search ..... 273/309, 273/342, 400–402; 473/496; 108/25
See application file for complete search history.

(56) References Cited

U.S. PATENT DOCUMENTS 2,608,454 A * 8/1952 Slattery ..... 108/26
3,001,791 A * 9/1961 Atwood ..... 473/470
3,372,934 A * 3/1968 Heil ..... 273/342
4,177,737 A * 12/1979 Brickman ..... 108/11
2002/0129746 A1* 9/2002 Donnelly ..... 108/25
2004/0188942 A1 9/2004 Trokan
2005/0029747 A1 2/2005 Grayson
2006/0226606 A1* 10/2006 Finley et al. ..... 273/342

* cited by examiner

*Primary Examiner*—Raleigh W. Chiu
(74) *Attorney, Agent, or Firm*—RatnerPrestia

(57) ABSTRACT

A beer pong table is disclosed. The table includes an elongated, planar top having a first end, a second end, and a longitudinal axis extending between the first end and the second end. The table also includes a bottom surface juxtaposed away from the top and a plurality of cup retainers disposed at each of the first and second ends. Each of the plurality of cup retainers extends from the top toward the bottom surface. An insert is removably inserted into each of the plurality of cup retainers.

20 Claims, 5 Drawing Sheets

BEER PONG TABLE

FIELD OF THE INVENTION

The present invention relates to a table top assembly for playing the game of Beer Pong.

BACKGROUND OF THE INVENTION

The game of "Beer Pong" is a popular game among young adults, particularly in bars and on college campuses. The game includes a table top, such as a ping pong table with the center net removed, and an array of drinking cups at each end of the table top. Each cup is filled with beer. Players on one side of the table attempt to throw or bounce a ping pong ball into one of the cups in the array on the other side of the table. If the ball lands in a cup, one of the players on that side of the table must drink the beer in that cup and remove the cup from play.

Attempts have been made to standardize the set-up of the cups into which the ping pong ball is being tossed. U.S. Patent Application Publication No. 2005/0029747 discloses a triangular holder, similar to a pool ball rack, for aligning the target cups at each end of the beer pong table. The holder includes ten circular cut-outs arranged in a triangular formation similar to a bowling pin arrangement. The holder is placed on a table and a cup is inserted into each cut-out. However, the holder is separate from the table and must be placed on the table prior to the start of the game. The holder must be properly aligned relative to the dimensions of the table, or one side may gain an unfair advantage over the side. Additionally, because the holder is separate from the table, the possibility exists that the holder may become separate from the table and lost or misplaced when it comes time to play the game.

It would be beneficial to provide a beer pong table wherein all of the cup holders are integral parts of the table so that the cup holders cannot get lost, misplaced, or broken, and wherein all of the cups can be located in the proper location for every game. It would also be beneficial to provide a beer pong table that is easily portable.

BRIEF SUMMARY OF THE INVENTION

Briefly, the present invention provides a beer pong table. The table includes an elongated, planar top having a first end, a second end, and a longitudinal axis extending between the first end and the second end. The table also includes a bottom surface juxtaposed away from the top and a plurality of cup retainers disposed at each of the first and second ends. Each of the plurality of cup retainers extends from the top toward the bottom surface. An insert is removably inserted into each of the plurality of cup retainers.

Further, the present invention also provides a beer pong table assembly comprising a first planar top portion having a first free end, a first connected end and a longitudinal axis extending between the first free end and the first connected end. A first bottom surface is juxtaposed away from the first planar top portion. A first cup retainer is disposed at the first free end. The first cup retainer extends from the first top portion toward the first bottom surface. A first insert is removably inserted into the first cup retainer. A second planar top portion has a second free end and a second connected end. The longitudinal axis extends between the second free end and the second connected end. A second bottom surface is juxtaposed away from the second planar top portion. A second cup retainer is disposed at the second free end. The second cup retainer extends from the second top portion toward the second bottom surface. A second insert is removably inserted into the second cup retainer.

Additionally, the present invention provides a beer pong table comprising an elongated, planar top having a first end and a second end, and a longitudinal axis extending between the first end and the second end. A bottom surface is juxtaposed away from the top. A plurality of cup retainers is disposed at each of the first and second ends. Each of the plurality of cup retainers is removably connected to the top.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
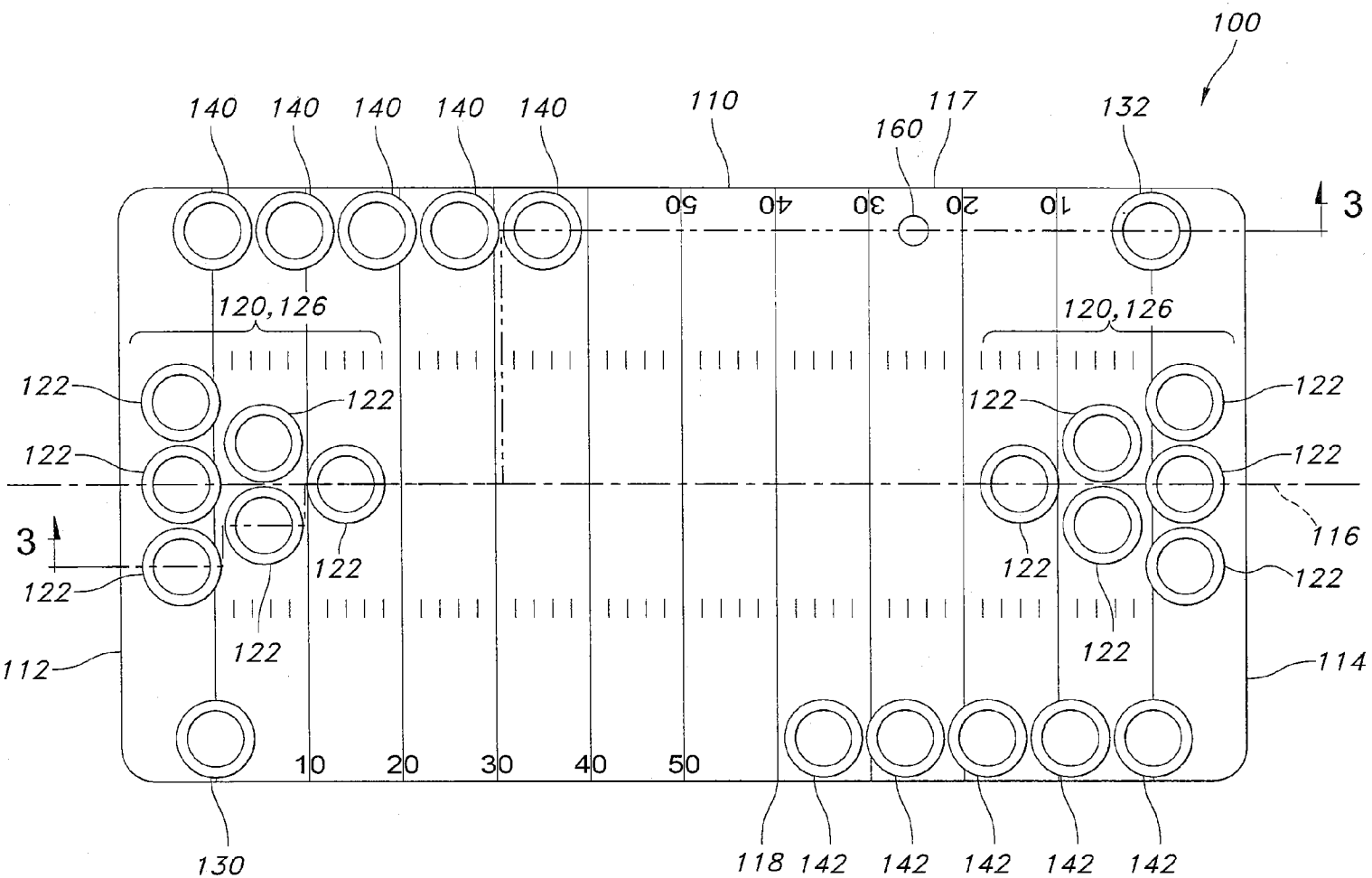
FIG. 1 is a top plan view of a first embodiment of a beer pong table according to the present invention.

In the drawings, like numerals indicate like elements throughout. In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Referring now to FIG. 1, a beer pong table 100 according to a first embodiment of the present invention is shown. The beer pong table 100 is used to play the beer drinking game known as "Beer Pong".

The table 100 includes an elongated, planar top 10 having a first end 112, a second end 114, and a longitudinal axis 116 extending between the first end 112 and the second end 114. Preferably, the top 110 extends at least seven feet between the first end 112 and the second end 114, and at least three feet along each of the first and second ends 112, 114. However, those skilled in the art will recognize that the top 110 may be of other dimensions instead.

The top 110 includes a first longitudinal side 117 that extends parallel to the longitudinal axis 116 between the first end 112 and the second end 114, and a second longitudinal side 118 that is juxtaposed across the longitudinal axis 116 from the first longitudinal side 117 and also extends between the first end 112 and the second end 114. Preferably, as shown in FIG. 1, corners formed by the junction of the first end 112 and the second end 114 with the first and second longitudinal sides 117, 118 are rounded, although those skilled in the art will recognize that the corners need not be rounded.

The top 110 may be decorated with artwork to enhance the enjoyment of playing the game. For example, as shown in FIG. 1, the top 110 may be painted in form of a football field. Alternatively, the top 110 may be painted in the form of a soccer field, a baseball field, a basketball court, a hockey rink, or other sports themes. Alternatively, college or fraternity logos, or even the name of a bar may be painted on the top 110.

Figure 2:
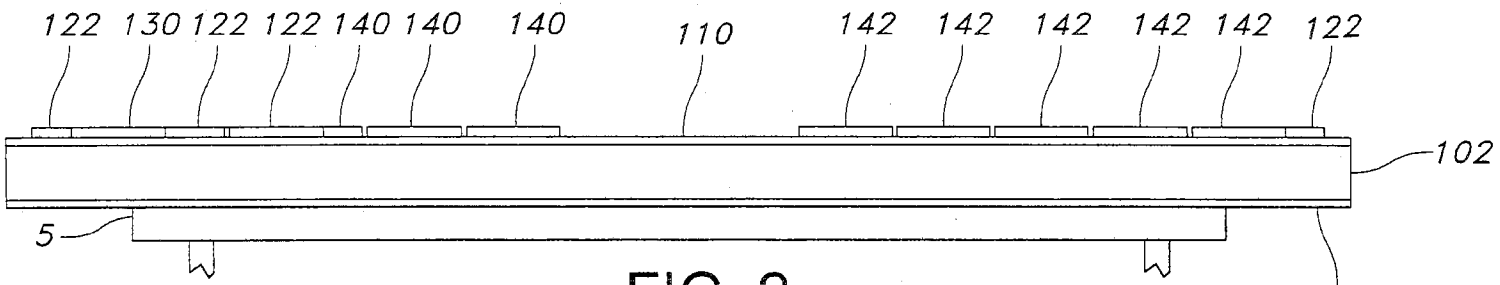
FIG. 2 is a side view of the beer pong table of FIG. 1.

Referring to FIG. 2, the table 100 also includes bottom 119 that is juxtaposed away from the top 110. The table 100 may include legs (not shown) that are connected to the bottom 119. The legs may be fixedly connected to the bottom 119 or removably connected to the bottom 119 for easier transport and storage of the table 100. Alternatively, the legs may be pivotally connected to the table 100 to allow the legs to be extended from the table for use, or pivoted against the bottom 119 for storage and transport.

Alternatively, the table 100 may be placed upon another surface S so that the bottom 119 engages the surface S. For example, the surface S may be another table, such as a ping pong table, a pool table, or any other table. Alternatively, the table 100 may be placed on saw horses or any other surface that will support the table 100. Preferably, the height of the top 110 of the table 100 is approximately three feet above a floor surface, although those skilled in the art will recognize that the top 10 may be located at other heights instead.

Figure 3:
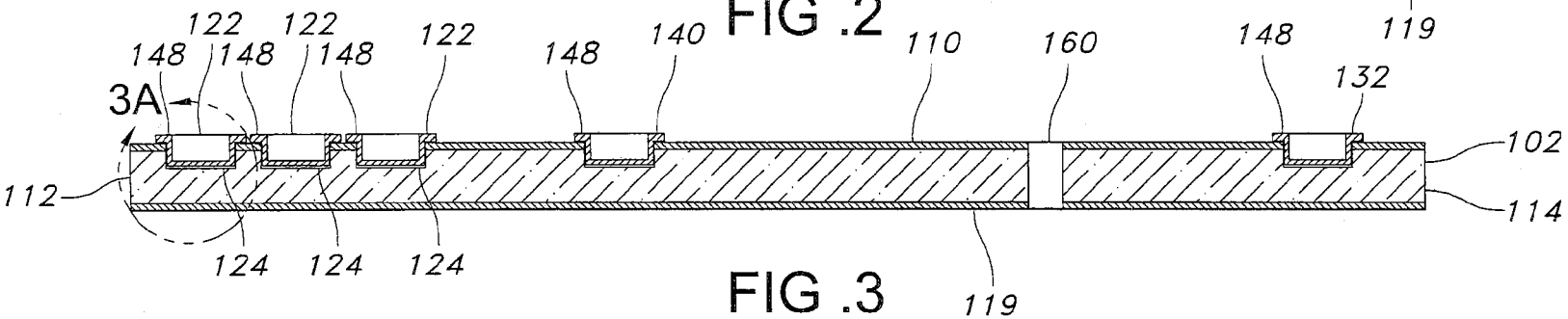
FIG. 3 is a sectional view of the beer pong table taken along lines 3-3 of FIG. 1.
Figure 3A:
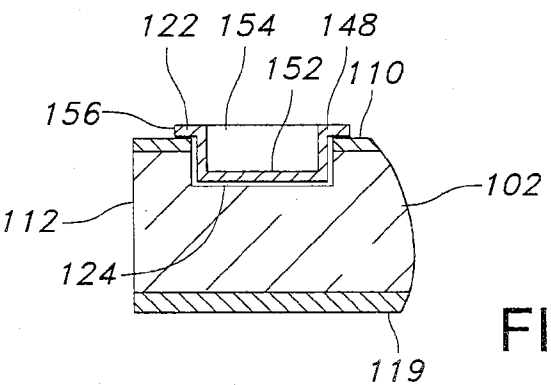
FIG. 3A is an enlarged portion of FIG. 3, taken along circle 3A of FIG. 3.

Referring back to FIG. 1, a cup retainer portion 120 is disposed at each of the first and second ends 112, 114. Each cup retainer portion 120 is symmetrically disposed along the longitudinal axis 116. The cup retainer portion 120 includes a plurality of drinking cup retainers 122 in the form of recess that extend below the plane of the top 100. Each drinking cup retainer 122 is sized to accept the bottom of a drinking cup (not shown), such as a sixteen ounce plastic cup. Each drinking cup retainer 122 provides an exact location for placement of each respective cup, and restricts lateral movement of each respective cup relative to the top 110. Referring to FIGS. 3 and 3A, each drinking cup retainer 122 also includes a base 124 for receiving the bottom of a drinking cup that is placed thereupon.

Preferably, the plurality of drinking cup retainers 122 are arranged in a triangular array 126, with the longitudinal axis 116 bisecting the array 126. As shown in FIG. 1, the array 126 includes six openings 122, although those skilled in the art will recognize that the array 126 may include ten openings 122 arranged similarly to bowling pins.

Still referring to FIG. 1, a first rinse cup retainer 130 is disposed along the first longitudinal side 117 at the first end 112 of the top 110 and a second rinse cup retainer 132 is disposed along the second longitudinal side 118 at the second end 114 of the top 110. Each rinse cup retainer 130, 132 includes a base 134. The rinse cup retainers 130, 132 are similar to the drinking cup retainers 122, but only one rinse cup retainer 130 is located at the first end 112 and only one rinse cup retainer 132 is located at the second end 114. The rinse cup retainers 130, 132 are used to receive and retain a rinse cup (not shown) in the same manner that each of the plurality of drinking cup retainers 122 retain a drinking cup. While FIG. 1 shows the rinse cup retainer 130 on one side of the longitudinal axis 116 and the rinse cup retainer 132 of an opposing side of the longitudinal axis 116, those skilled in the art will recognize that the rinse cup retainers 130, 132 may be located on the same side of the longitudinal axis 116.

A plurality of empty cup retainers 140 are disposed along the second longitudinal side 118 at the first end 112 of the top 110 and a plurality of empty cup retainers 142 are disposed along the first longitudinal side 117 at the second end 114 of the top 110. Each empty cup retainer 140, 142 includes a base 144. The empty cup retainers 140, 142 are similar to the drinking cup retainers 122. Preferably, the plurality of empty cup retainers 140 is one less than the number of drinking cup retainers 122 and, similarly, the plurality of empty cup retainers 142 is also one less than the number of drinking cup retainers 122. The empty cup retainers 140, 142 are used to receive and retain an empty drinking cup after the drinking cup is removed from its respective drinking cup retainer 122. While FIG. 1 shows the empty cup retainers 140 on one side of the longitudinal axis 116 and the empty cup retainers 142 of an opposing side of the longitudinal axis 116, those skilled in the art will recognize that the empty cup retainers 140, 142 may be located on the same side of the longitudinal axis 116.

Since the table 100 is used in a beer drinking game, it is envisioned that beer will eventually spill onto the table 100, either from landing balls into the drinking cups, or by sloppy play from those playing the game. The spilled beer will likely find its way into the drinking cup retainers 122, the rinse cup retainers 130, 132, and the empty cup retainers 140, 142, where the beer will likely not be cleaned out, leaving the table 100 smelling like stale beer and reducing the enjoyment of the players.

To counter this inevitability, plastic inserts 148 are removably inserted into each of the drinking cup retainers 122, the rinse cup retainers 130, 132, and the empty cup retainers 140, 142. Referring to FIGS. 3 and 3A, the plastic inserts 148 are preferably generally cup-shaped and sized to snugly, but removably, fit into each of the drinking cup retainers 122, the rinse cup retainers 130, 132, and the empty cup retainers 140, 142. Referring to FIG. 3A only, each insert 148 includes a circular base 152 and a tubular sidewall 154 that extends upward from the base 152. A lip 156 extends from the top of the sidewall 154 and outward so that, when the insert 148 is inserted into one of the drinking cup retainers 122, the rinse cup retainers 130, 132, and the empty cup retainers 140, 142, the lip 156 extends slightly over the top 110 to restrict the ability of spilled beer to flow into the drinking cup retainers 122, the rinse cup retainers 130, 132, and the empty cup retainers 140, 142 into which the insert 148 is inserted.

After players are finished playing the game, or after a particularly bad beer spill, the inserts 148 may be removed from their respective drinking cup retainers 122, the rinse cup retainers 130, 132, and the empty cup retainers 140, 142 and the top 110 may then be washed. The inserts 148 may be cleaned, such as under running water or in a dishwasher.

One preferred method of manufacturing the table 100 is to use a laminated sheet of material for the top 110 and for the bottom 119. Preferably, the table 100 is constructed from a foam core 102 or some other suitable material. The core 102 may be laminated on its top and bottom with CINTRA™ and secured to the table 100 by an adhesive. Alternatively, the table 100 may be constructed from powder coated medium density fiberboard (MDF) or injection molded plastic. The drinking cup retainers 122, the rinse cup retainers 130, 132, and the empty cup retainers 140, 142 are cut through the top 110, such as by a CNC machine. Preferably, the drinking cup retainers 122, the rinse cup retainers 130, 132, and the empty cup retainers 140, 142 are not cut all the way through to the bottom 119, so that the inserts 148 rest solidly in each of the drinking cup retainers 122, the rinse cup retainers 130, 132, and the empty cup retainers 140, 142. Preferably, the inserts 148 are manufactured from low density polyethylene (LDPE) or some other suitable polymer.

Optionally, a beer tap receptacle (not shown) may extend through the top 110. The beer tap receptacle fits through a tap opening 160 (shown in FIGS. 1 and 3) that extends between the top 110 and the bottom 119 of the table 100. While one tap opening 160 is shown, those skilled in the art will recognize that more than one tap opening 160 may be formed in the table 100.

Figure 4:
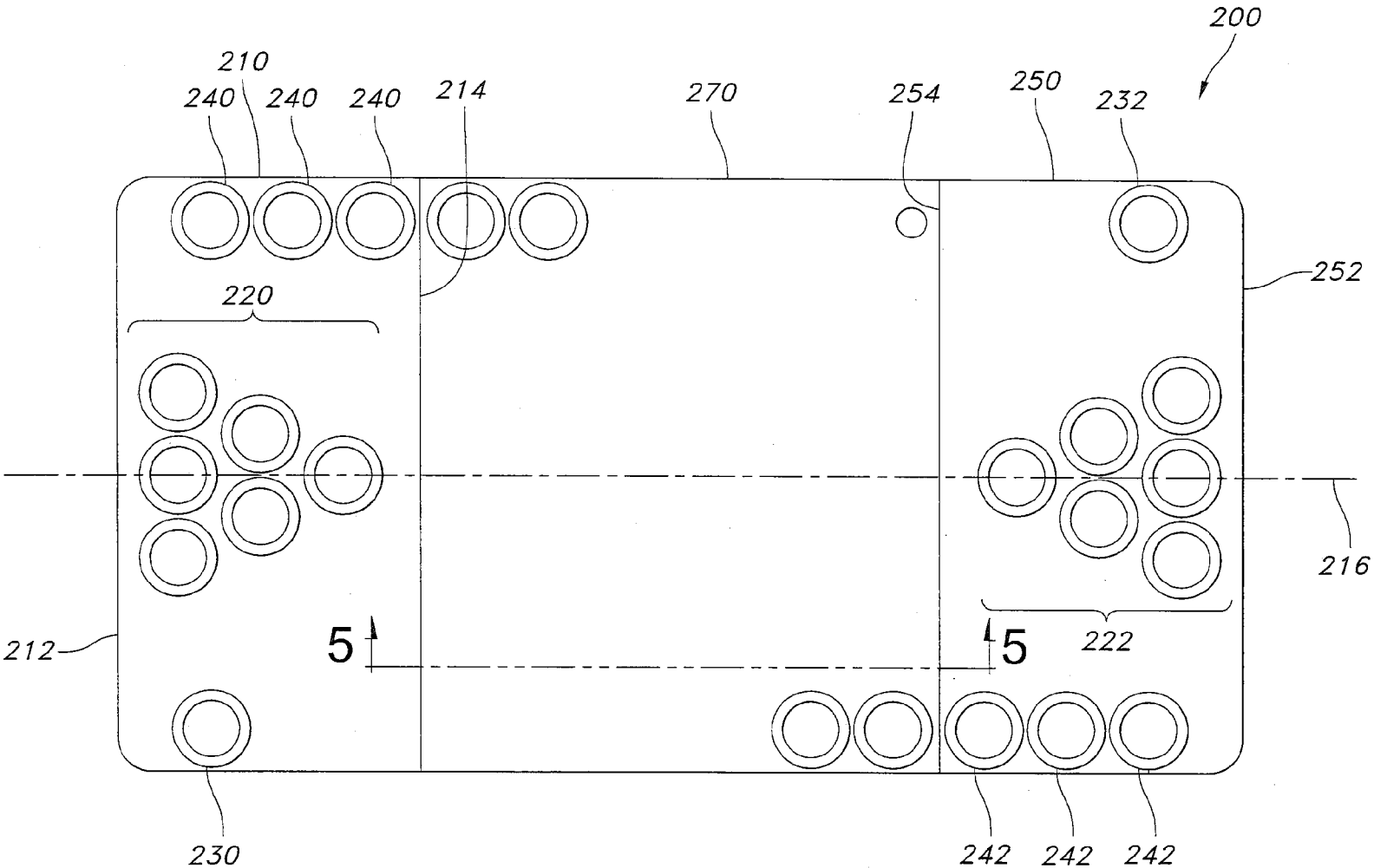
FIG. 4 is a top plan view of a second embodiment of a beer pong table according to the present invention.

A beer pong table assembly 200 according an alternative embodiment of the present invention is shown in FIG. 4. The assembly 200 includes a plurality of table portions that are arrangeable together to form a beer pong table. The assembly 200 includes a first planar top portion 210, a second planar top portion 250, and a third planar top portion 270. The planar top portions 210, 250, 270 are easily transportable, making the assembly 200 less cumbersome to move than the table 100 as described above. When placed end-to-end, the planar top portions 210, 250, 270 preferably extend at least seven feet in length, although those skilled in the art will recognize that the planar top portions 210, 250, 270 may extend a total of less than seven feet in length.

The first planar top portion 210 includes a first free end 212 and a first connected end 214. A longitudinal axis 216 extends between the first free end 212 and the first connected end 214. A first cup retainer portion 220 is disposed at the first free end 212. The first cup retainer portion 220 is symmetrically disposed along the longitudinal axis 216.

The first planar top portion 210 also includes a rinse cup retainer 230 and a plurality of empty cup retainers 240 similar to the rinse cup retainer 130 and the empty cup retainers 140 described above with respect to the table 100.

The second planar top portion 250 has a second free end 252 and a second connected end 254. The longitudinal axis 216 extends between the second free end 252 and the second connected end 254. A second cup retainer portion 222 is disposed at the second free end 252. The second cup retainer portion 222 is symmetrically disposed along the longitudinal axis 216.

The second planar top portion 250 also includes a rinse cup retainer 232 and a plurality of empty cup retainers 242 similar to the rinse cup retainer 132 and the empty cup retainers 142 described above with respect to the table 100.

The third planar top portion 270 is preferably disposed between the first connected end 214 and the second connected end 254. However, those skilled in the art will recognize that, if the first and second planar top portions 210, 250 are sufficiently long, then the third planar top portion 270 may be omitted. Those skilled in the art will also recognize that additional top planar portions (not shown) may be located between the first and second planar top portions 210, 250.

Figure 5:
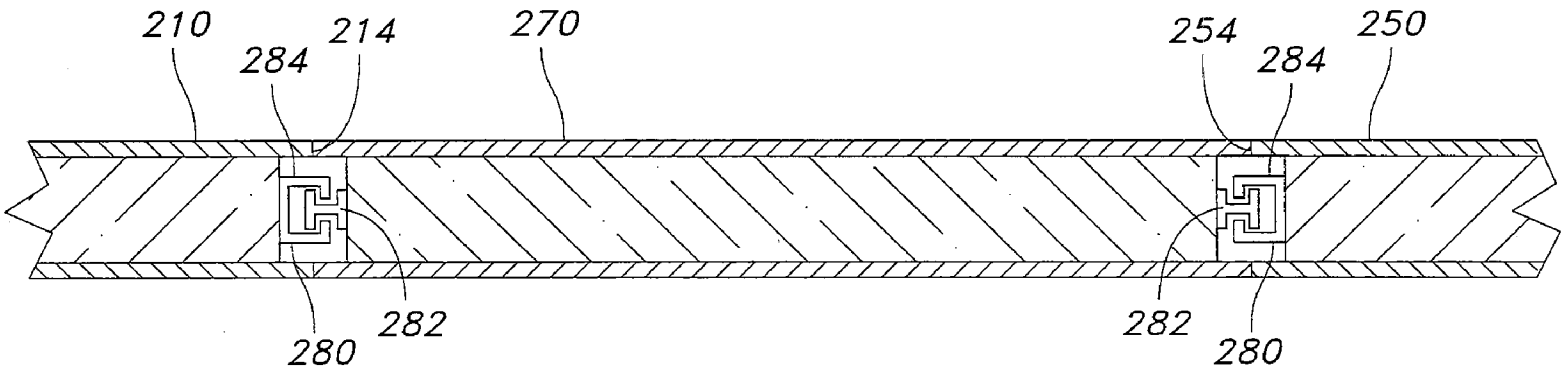
FIG. 5 is a sectional view of the beer pong table taken along lines 5-5 of FIG. 4.

Referring to FIG. 5, the third planar top portion 270 may be connected to each of the first connected end 214 and the second connected end 254, such as by tongue and groove connectors 280. A first tongue portion 282 may be connected to the third top planar portion 270, while a groove portion 284 may be connected to the connected end 214, 254 of each of the first and second planar top portions 210, 250, respectively.

Alternatively, those skilled in the art will recognize that the third planar top portion 270 may simply be wedged between the first planar top portion 210 and the second planar top portion 250, without any device or structure to physically secure the third planar top portion 270 to either of the first or second planar top portions 210, 250.

Optionally, the third planar top portion 270 may be omitted in its entirety, and only the first and second planar top portions 210, 250 need be used, such as in a travel kit. The first and second planar top portions 210, 250 are placed at opposing ends of a table, such as a ping pong table, and the game is ready for play.

Figure 6:
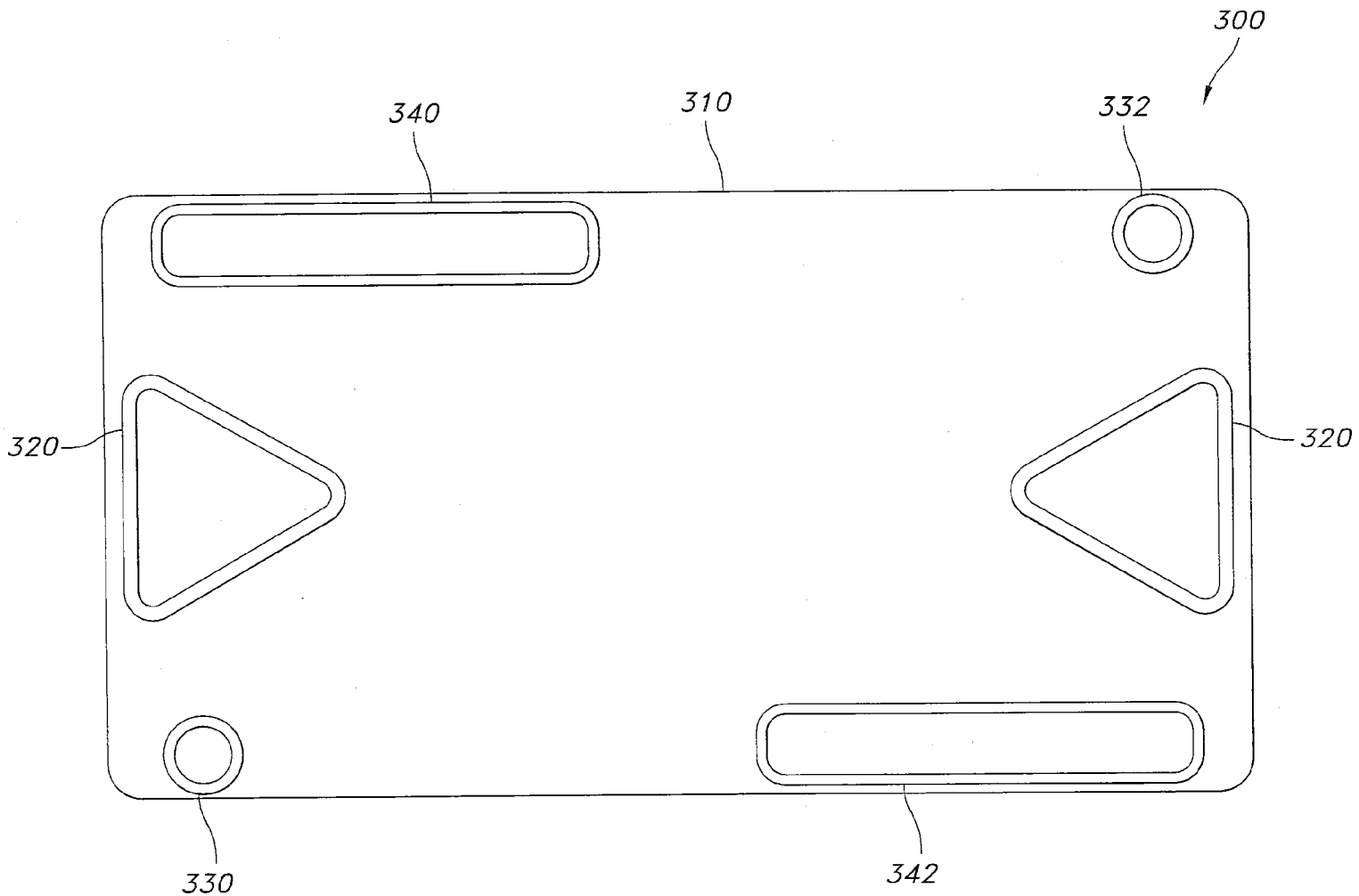
FIG. 6 is a top plan view of a beer pong table according to a third embodiment of the present invention.

An alternate embodiment of a beer pong table 300 is shown in FIG. 6. The beer pong table 300 is similar to the beer pong table 100 shown above, with the exception that, instead of a retainer portion 120 that includes an array of drinking cup retainers 122 for individually retaining each cup on the table 100, the table 300 includes a generally triangular retainer portion 320 into which the cups may be placed. The retainer portion 320 is removably inserted into a similarly sized cutout in the top 310. Similarly, the plurality of empty cup retainers 140, 142 have been replaced by single, elongated retainers 340, 342 that are removably inserted into a similarly sized cutout in the top 310. While a one-piece table 300 is shown, those skilled in the art will recognize that the table 300 may also come as part of an assembly similar to the assembly 200 described above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A beer pong table comprising:

an elongated, planar top having a first end, a second end, and a longitudinal axis extending between the first end and the second end;

a bottom surface juxtaposed away from the top;

a plurality of cup retainers disposed at each of the first and second ends, wherein each of the plurality of cup retainers extends from the top toward the bottom surface; and an insert removably inserted into each of the plurality of cup retainers.

2. The beer pong table according to claim 1, further comprising means for supporting the top above a floor surface, wherein the means engages the bottom surface.

3. The beer pong table according to claim 1, wherein the top comprises a first longitudinal side extending parallel to the longitudinal axis.

4. The beer pong table according to claim 3, further comprising a rinse cup retainer disposed along the first longitudinal side.

5. The beer pong table according to claim 3, further comprising an empty cup retainer disposed along the first longitudinal side.

6. The beer pong table according to claim 1, further comprising an athletic playing surface printed on the top.

7. The beer pong table according to claim 1, further comprising a beer tap receptacle extending through the top.

8. A beer pong table assembly comprising:

a first planar top portion having a first free end, a first connected end and a longitudinal axis extending between the first free end and the first connected end;

a first bottom surface juxtaposed away from the first planar top portion;

a first cup retainer disposed at the first free end, wherein the first cup retainer extends from the first top portion toward the first bottom surface;

a first insert removably inserted into the first cup retainer;

a second planar top portion having a second free end and a second connected end, wherein the longitudinal axis extends between the second free end and the second connected end;

a second bottom surface juxtaposed away from the second planar top portion;

a second cup retainer disposed at the second free end, wherein the second cup retainer extends from the second top portion toward the second bottom surface; and a second insert removably inserted into the second cup retainer.

9. The beer pong table assembly according to claim 8, further comprising a third planar top portion disposed between the first connected end and the second connected end.

10. The beer pong table assembly according to claim 8, wherein the first top portion comprises a first longitudinal side extending parallel to the longitudinal axis.

11. The beer pong table assembly according to claim 10, further comprising a rinse cup retainer disposed along the first longitudinal side.

12. The beer pong table assembly according to claim 10, further comprising an empty cup retainer disposed along the first longitudinal side.

13. The beer pong table assembly according to claim 8, further comprising an athletic playing surface printed on the first planar top portion.

14. The beer pong table assembly according to claim 8, further comprising a beer tap receptacle extending through the first planar top portion.

15. A beer pong table comprising:

an elongated, planar top having a first end and a second end, and a longitudinal axis extending between the first end and the second end;

a bottom surface juxtaposed away from the top; and a plurality of cup retainers disposed at each of the first and second ends, wherein each of the plurality of cup retainers is removably connected to the top.

16. The beer pong table according to claim 15, further comprising means for supporting the top above a floor surface, wherein the means engages the bottom surface.

17. The beer pong table according to claim 15, wherein the top comprises a first longitudinal side extending parallel to the longitudinal axis.

18. The beer pong table according to claim 17, further comprising a rinse cup retainer disposed along the first longitudinal side.

19. The beer pong table according to claim 17, further comprising an empty cup retainer disposed along the first longitudinal side.

20. The beer pong table according to claim 15, wherein each of the plurality of cup retainers extends upward from the top.

* * * * *